United States Patent [19]

Tokunaga et al.

[11] 3,942,287

[45] Mar. 9, 1976

[54] CONTOUR GRINDERS

[75] Inventors: Yoshio Tokunaga, Higashikurume; Keizo Shinano, Mitaka, both of Japan

[73] Assignee: Citizen Watch Company, Ltd., Tokyo, Japan

[22] Filed: Oct. 7, 1974

[21] Appl. No.: 512,930

[30] Foreign Application Priority Data

| | | |
|---|---|---|
| Nov. 10, 1973 | Japan | 48-125911 |
| Nov. 10, 1973 | Japan | 48-129451[U] |
| Oct. 10, 1973 | Japan | 48-129452[U] |

[52] U.S. Cl. ..... 51/5 D; 51/35; 51/43; 51/165 TP; 51/DIG. 14

[51] Int. Cl.[2] ..... B24B 17/00; B24B 49/10

[58] Field of Search ..... 51/5 D, 32, 33 R, 34 R, 51/34 E, 35, 43, 45, 90, DIG. 14, 165 TP, 165.77, 165.87

[56] References Cited

UNITED STATES PATENTS

| | | | |
|---|---|---|---|
| 1,045,243 | 11/1912 | Zeitz | 51/43 |
| 1,500,963 | 7/1924 | Speegle | 51/43 |
| 1,674,673 | 6/1928 | Williams | 51/43 |
| 1,817,405 | 8/1931 | Braren | 51/DIG. 14 |
| 3,105,413 | 10/1963 | Lanzenberger | 51/43 X |
| 3,118,254 | 1/1964 | DiLella | 51/45 |
| 3,289,355 | 12/1966 | Coburn | 51/33 |

*Primary Examiner*—Donald G. Kelly
*Attorney, Agent, or Firm*—Stevens, Davis, Miller & Mosher

[57] ABSTRACT

A contour grinder having a grinding wheel that forms a workpiece into a desired contour by directly controlling the movement of the grinding wheel with a motor operated by numerical control. The grinding wheel has an arched shaped surface on the periphery thereof. The grinder also includes a vertical shaft about which the grinding wheel is rotatable and a support arm which carries a horizontal shaft to which the grinding wheel is fixed. The support arm is rotatably connected to a portion of the vertical shaft and connects the horizontal shaft at a right angle thereto so that the center of the arched surface on the periphery of the grinding wheel is aligned with the center of the vertical shaft. The vertical shaft is rotatable about its axis and movable longitudinally and laterally and the grinding wheel is movable with the vertical shaft. The vertical shaft is hollow and a microscope, marked with reference lines for inspecting the shape of the periphery of the grinding wheel and the position of the workpiece to be ground by the grinding wheel, is mounted in the hollow shaft.

11 Claims, 10 Drawing Figures

CONTOUR GRINDERS

The present invention relates to a contour grinder that forms a workpiece into a desired shape by grinding along its contour.

Conventionally grinders have been used to form a workpiece into a desired shape either by vertically moving the workpiece at a fixed position, moving a follower, which resembles a grinding wheel in shape, along the edge of the template formed to the desired shape, and transmitting the movement of the follower to the grinding wheel by means of a pantograph, or, otherwise, by pressing the periphery of a grinding wheel against a workpiece by vertically moving a horizontally disposed grinding wheel, moving the workpiece vertically and horizontally on a plane, projecting a grinding position on a screen on an enlarged scale, and performing grinding in accordance with the contour projected thereon.

As may be understood from the above, conventional grinders have all been contour grinders requiring such templates or contour projectors as described above. In such grinders, the drive belt of the grinding wheel extends downward, with the workpiece holder standing in its way. Therefore, the grinding wheel can be swung through only about 180°. Consequently, it is impossible to work the entire contour of the workpiece at a time. When working the entire contour, therefore, the workpiece is divided into several sections, which are recombined after grinding. In another arrangement, separate means for rotating and driving the workpiece may be provided on the table. This method, however, necessitates complex operations concerning the inter-relations among the vertical and horizontal movements, revolution and driving of the workpiece and the swinging and other movements of the grinding wheel.

To eliminate the aforesaid defects, this invention provides grinding means that form a workpiece into a desired contour by directly controlling the movement of a grinding wheel with a prime mover operated by numerical control means, without resorting to the above-described contour following method. That is, the present invention relates to means that is capable of automatically grinding the contour of the workpiece throughout its entire periphery, comprising a grinder the arched surface of the periphery of which is adapted to be pressed against the workpiece moving up and down in a fixed position, a shaft for swinging and revolving the grinding wheel positioned on the extension of the center line of said circle, and a support arm, fitted with a revolution shaft of the grinding wheel, which is rotatingly adjustably fitted to a suitable position on said swinging or revolving shaft, wherein swinging and revolution of the grinding wheel is controlled by the driving of said swinging or revolving shaft, and shifting thereof by the vertical and horizontal displacement of the same shaft.

Now an embodiment of this invention will be described with reference to the accompanying drawings in which.

Figure 1:
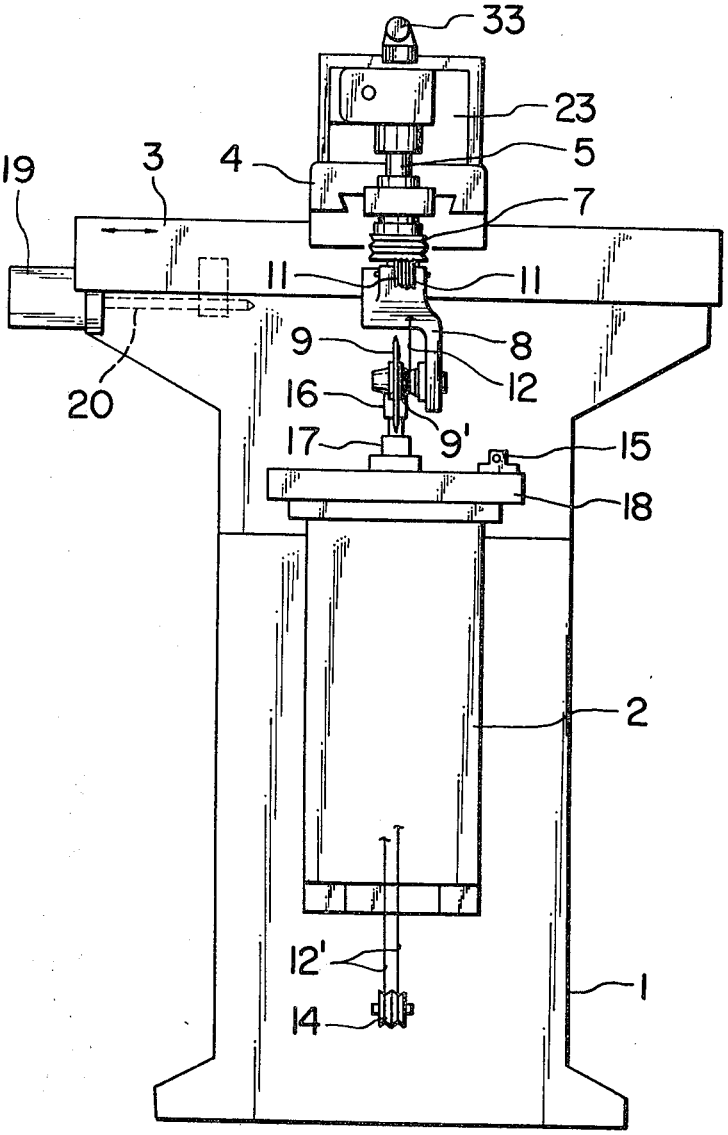
FIG. 1 is a front view in elevation of a grinding machine made in accordance with the teachings of the present invention.
Figure 2:
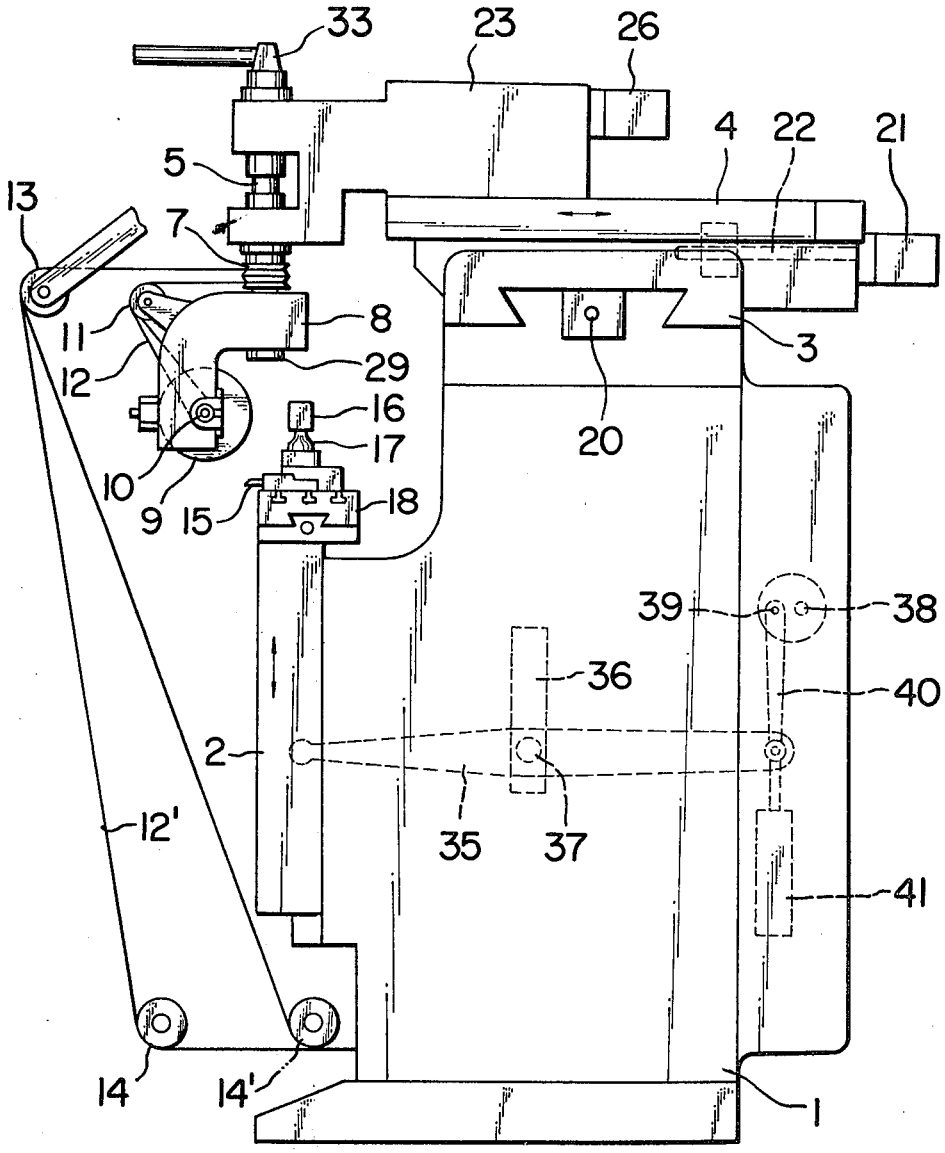
FIG. 2 is a side view of the machine of FIG. 1 with the driving means for the vertically sliding member which holds the workpiece schematically indicated in broken lines.
Figure 3:
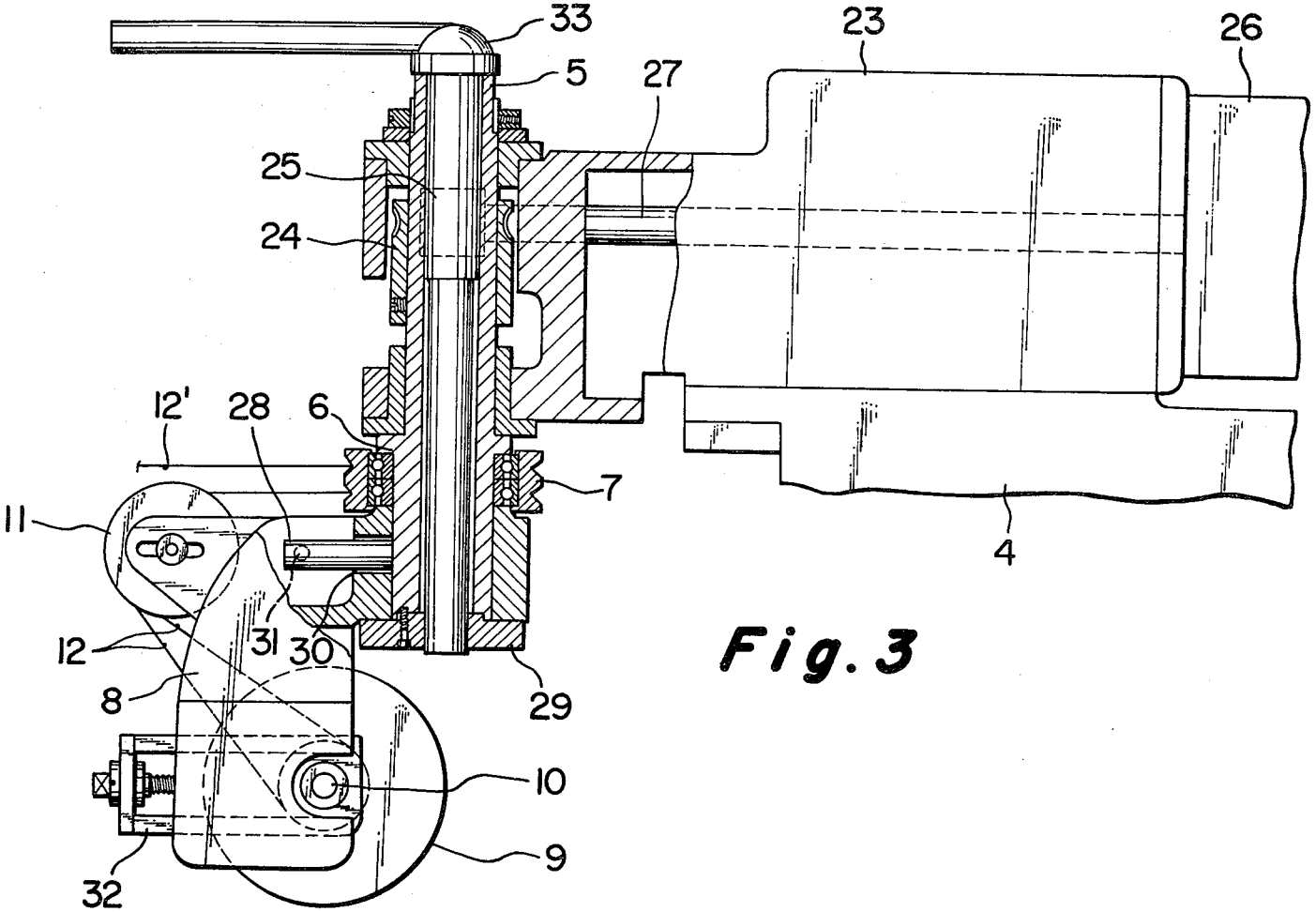
FIG. 3 is a view partly in elevation and partly in vertical section of the grinding wheel support mechanism.
Figure 5:
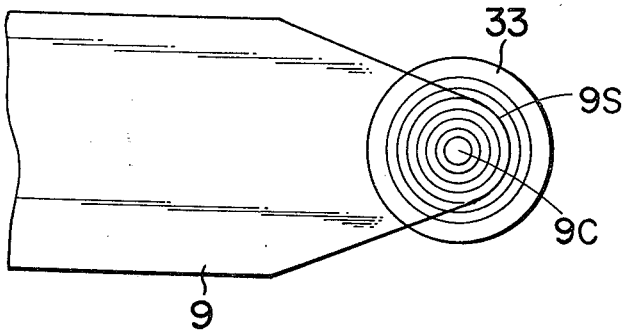
FIG. 5 is a fragmentary view to an enlarged scale illustrating the use of a microscope to locate the precise periphery of the grinding wheel.

In FIGS. 1, 2 and 3, a grinding machine proper 1 (hereinafter called the "machine") is provided with a vertically sliding member 2, a longitudinally moving table 3, and a table 4 that moves laterally on said table 3. In front of the laterally moving table 4 there is a vertical shaft 5 which is suitably driven rotatingly or swingingly on its own axis. There is an eccentric portion 6 formed in the lower part of the vertical revolving shaft 5. To said eccentric portion 6 there is mounted for rotation relative to the portion 6 a pulley 7, having two horizontal grooves, and a support arm 8. The support arm 8 is curved, and is fitted, in its lower end portion, with a horizontal shaft 10, so mounted for rotation that it may be moved back and forth. Fixed to the shaft 10 is a grinding wheel 9 and a sheave 9′. The periphery of the grinding wheel 9 is arched as at 9A (FIG. 5), with the edge tangent to an extension of the axial center line of said vertical shaft 5. The center 9C of the arched surface 9A is also shown in FIG. 5. Said support arm 8 is fitted with a shaft that supports two pulleys 11 for rotation. A driving belt 12 for the grinding wheel 9, passed over the sheave 9′ fixed on the horizontal revolving shaft of the grinding wheel 9, is passed through said two pulleys 11 over the lower groove on the pulley on the vertical shaft 5. A driving belt 12′ is passed over the upper groove on said pulley 7, through a double tension pulley 13 at the end of a rod provided on the laterally moving table 4, see FIG. 2, deflecting pulleys 14, and 14′ fitted to the machine 1, and thence to a suitable motor (not shown). The pulley 7, which is rotatably mounted on the shaft 5, is provided with two grooves. When the upper one of the pair of the two grooves is driven by belt the , the lower one drives the sheave 9′.

On the top of the vertically sliding member 2 is mounted a movable table 18, having means 15 for dressing the circular periphery of the grinding wheel 9 and a holder 17 that carries a workpiece 16 at a predetermined height, for instance, at such a height that does not prevent the grinding wheel 9 from revolving through 360° round the vertical shaft. To permit the grinding wheel to revolve through 360° round the vertical shaft, a void must necessarily be formed in a desired portion of the machine 1.

Now details of the principal parts of the above-described embodiment will be discussed.

The table 3 is moved back and forth by a threaded bar 20 rotated by a pulse motor (see FIG. 1) 19 fitted to the machine 1. On the table 3 there is provided the table 4 that is laterally moved by a threaded bar 22 rotated by a pulse motor 21 fitted to said table 3. By reference to FIG. 3 it will be seen that a worm wheel 24 is fixed to the vertical shaft 5, which is rotatably supported by a screw nut, with a bearing washer therebetween, within a sleeve provided at the end of a support table 23. A worm 25 engaging with said worm wheel 24 is fitted to a driving shaft 27 driven by a pulse motor 26 attached to said support table 23.

Figure 4:
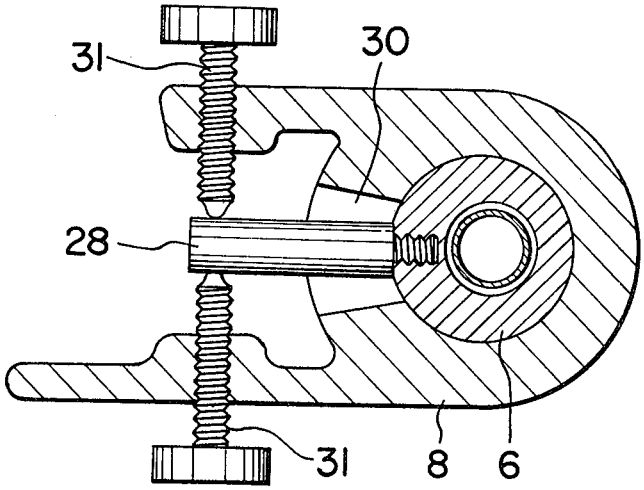
FIG. 4 is a fragmentary view to an enlarged scale of an apparatus for precisely angularly positioning the support arm on which the grinding wheel assembly is mounted.

A rotation control pin 28 is planted in the eccentric portion 6 formed in the lower part of said vertical shaft 5. Said rotation control pin 28 is projected through a horizontal slot 30 provided in the grinding wheel support arm 8 supported in said eccentric portion 6 by a flange washer 29 fixed to the lower end of the vertical shaft 5. The front end of the pin 28 is held between the tips of adjusting screw bars 31 oppositely screwed through both external walls of the support arm 8, as illustrated on an enlarged scale in FIG. 4, thereby adjusting the relative position of the grinding wheel with respect to the revolving axis by means of said adjusting screw bars 31.

The horizontal revolving shaft 10 of the grinding wheel supported in grooves at the front sides of the support arm 8 is fitted to a member that is slid, by the rotation of the threaded bar, over a guide frame 32 attached to said support arm 8, and thereby moves back and forth with respect to the axis of the vertical shaft 5.

The vertical shaft 5 is a hollow shaft, and a microscope 33 is provided in this hollow shaft. Many concentric circles are marked at the top portion of the microscope 33, provided at the top of the vertical shaft 5. As illustrated in FIG. 5, these concentric circles are for checking the accuracy of arched surface of the periphery of the grinding wheel centered at the axis of the vertical shaft 5.

Figure 6:
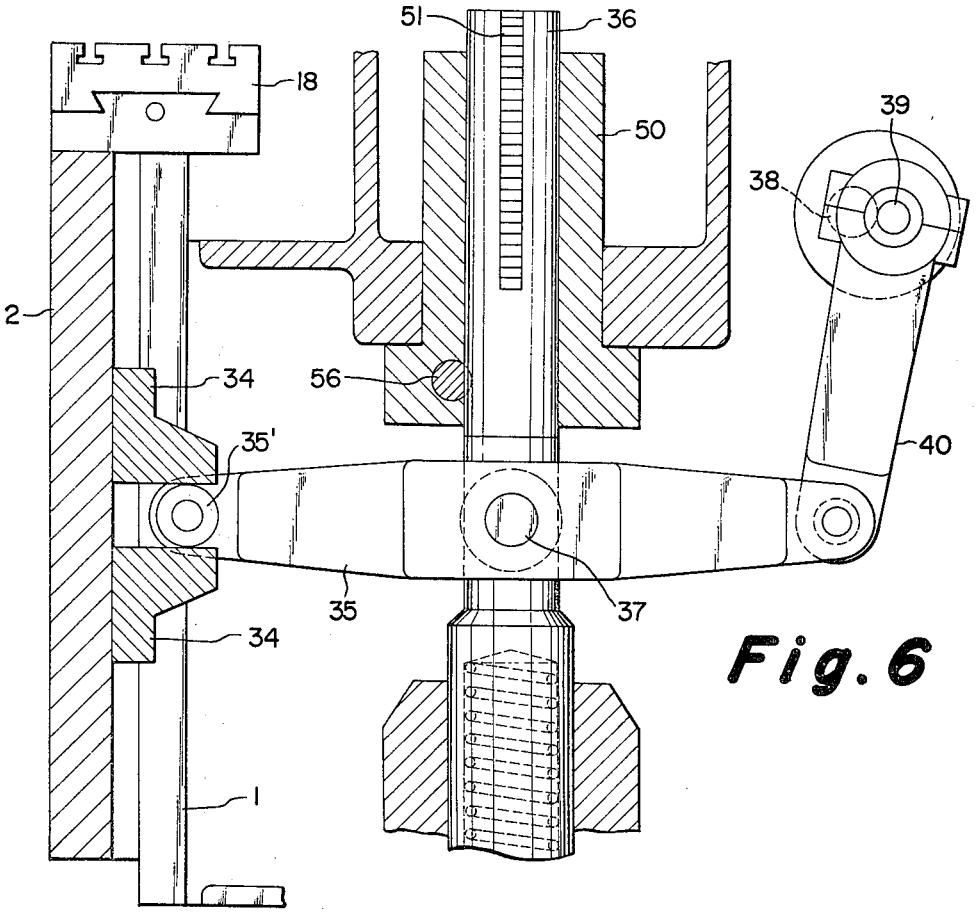
FIG. 6 is a fragmentary view partly in elevation and partly in vertical section of the mechanism for moving the vertically slidable work holder.

FIG. 6 shows a driving mechanism of the vertically sliding member 2. A lever 35 has at one end thereof a roller 35′ that is movable between a pair of support pieces 34 oppositely fitted to the vertically sliding member 2. The lever 35 swings on a pin 37, which serves as a fulcrum, on a stroke position adjusting shaft (hereinafter called the "adjusting shaft") 36 inserted in a sleeve within the machine 1 so as to permit only vertical movement. At the other end of said lever 35 there is provided reciprocatingly driving means. Said reciprocatingly driving means has an eccentric shaft 39 driven by a driving shaft 38 supported inside the machine 1, and a connecting rod 40 one end of which is pivotally connected to said eccentric shaft 39 and the other end to the later mentioned end of said lever 35. Also a balance weight 41, see FIG. 2, is hung so as to facilitate the sliding of the vertically sliding member 2.

Figure 7:
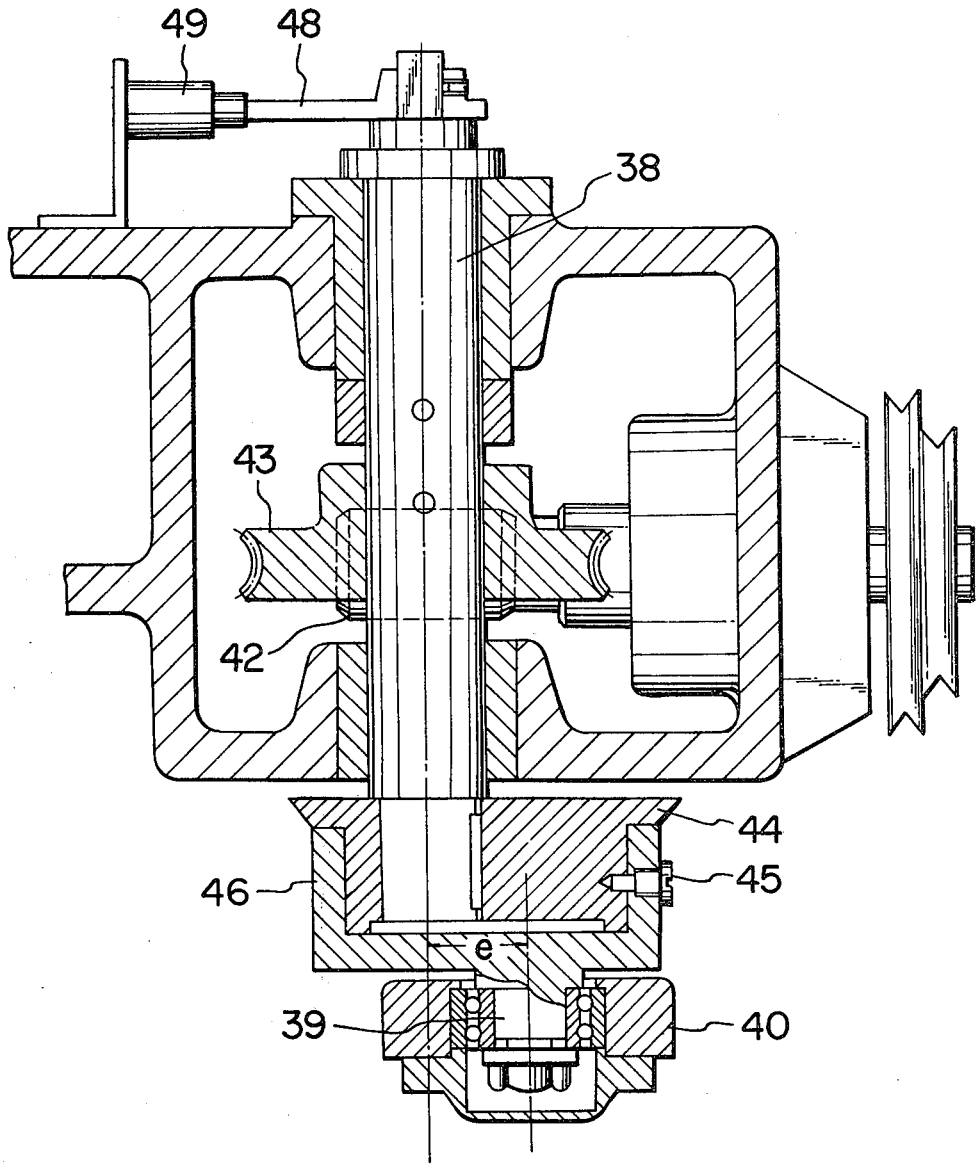
FIG. 7 is a view in horizontal section of the mechanism of the eccentric for reciprocatingly driving the vertically slidable work holder member.

FIG. 7 illustrates the details of said reciprocatingly driving means. The driving shaft 38 is fixed with a worm wheel 43 engaged with a worm 42 that is driven, through a transmission gear, by a suitable motor (not shown) provided in the machine 1. At one end of said driving shaft 38 is fixed an eccentric 44. Said eccentric shaft 39, having an eccentricity e with respect to the axis of driving shaft 38, is fitted to a ring 46 that is fitted over said eccentric so as to be rotated and fixed at any desired position by means of a bolt 45. The eccentric shaft 39 is connected with one end of said connecting rod 40, with a bearing therebetween. By rotating the ring 46 with respect to the eccentric 44 and fixing the former at a desired position with the bolt 45, the eccentricity e may optionally be selected and changed. By this means, the stroke of the reciprocating motion of the vertically sliding member 2 may be changed to a desired length. A rotatable and fixable switch lever 48 is fitted to the other end of said driving shaft 38. A switch 49, which is on-off operated by said switch lever 48, is fixed at a predetermined position of the machine 1. This limit switch 49 controls the motor for driving said worm 42, whereby a position at which the rotation of the driving shaft 38 is to be stopped is established and the vertically sliding member is moved to a predetermined height, thus preparing for the dressing operation.

Figure 8:
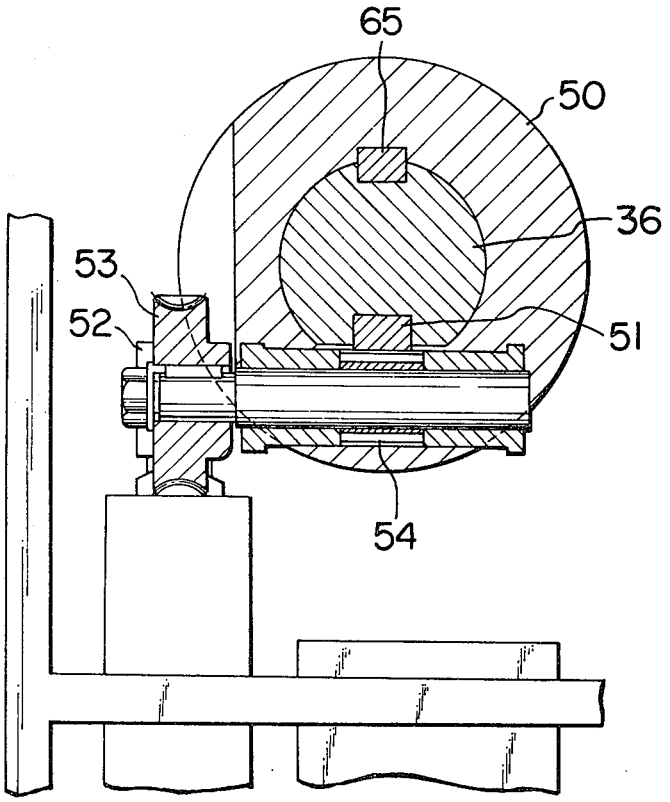
FIG. 8 is a view in section of a mechanism for adjusting the position of the fulcrum of an operating lever shown in FIG. 6.

The adjusting shaft 36, having a fulcrum shaft 37 of the lever 35, is inserted in a sleeve 50 provided in the machine 1 so as to permit only vertical movement, without rotating, and fixes a rack rod 51 (see FIG. 6). This rack rod 51, as illustrated in FIG. 8, moves up and down the adjusting shaft 36, engaging with a pinion 54 fixed on the shaft of a worm wheel 53 engaging with a worm 52 driven by the motor (not shown) provided in the machine 1. Consequently, the position of the pin 37 changes with the vertical motion of the adjusting shaft 36, which in turn moves up or down the center of the reciprocating motor of the stroke of the vertically sliding member 2, thereby changing the upper and lower moving limits of the workpiece 16.

Figure 9:
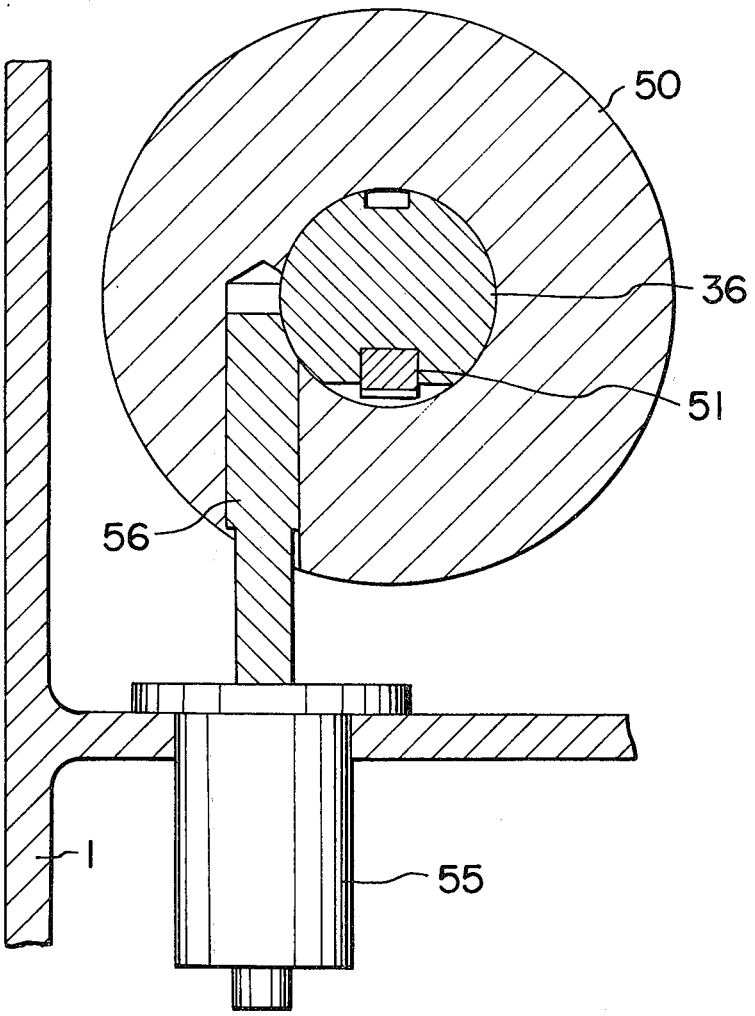
FIG. 9 is a transverse section of a portion of the fulcrum mechanism illustrated in FIG. 6; and, FIG. 10 is a fragmentary view in elevation showing limit switches which control the moving of the grinding wheel dressing apparatus to a predetermined dressing position and back to a predetermined original position.

The details of locking means, after the adjustment of the adjusting shaft 36 are shown in FIG. 9. That is a hole that reaches the periphery of the adjusting shaft 36 is made in the sleeve 50, and is inserted with a wedge-pointed piston rod 56 that is moved back and forth by means of a cylinder device 55 provided within the machine 1. Locking and releasing are effected by engaging and disengaging said wedge-shaped point with and from the periphery of the adjusting shaft 36. The adjusting shaft 36 is urged upwards by a spring.

Figure 10:
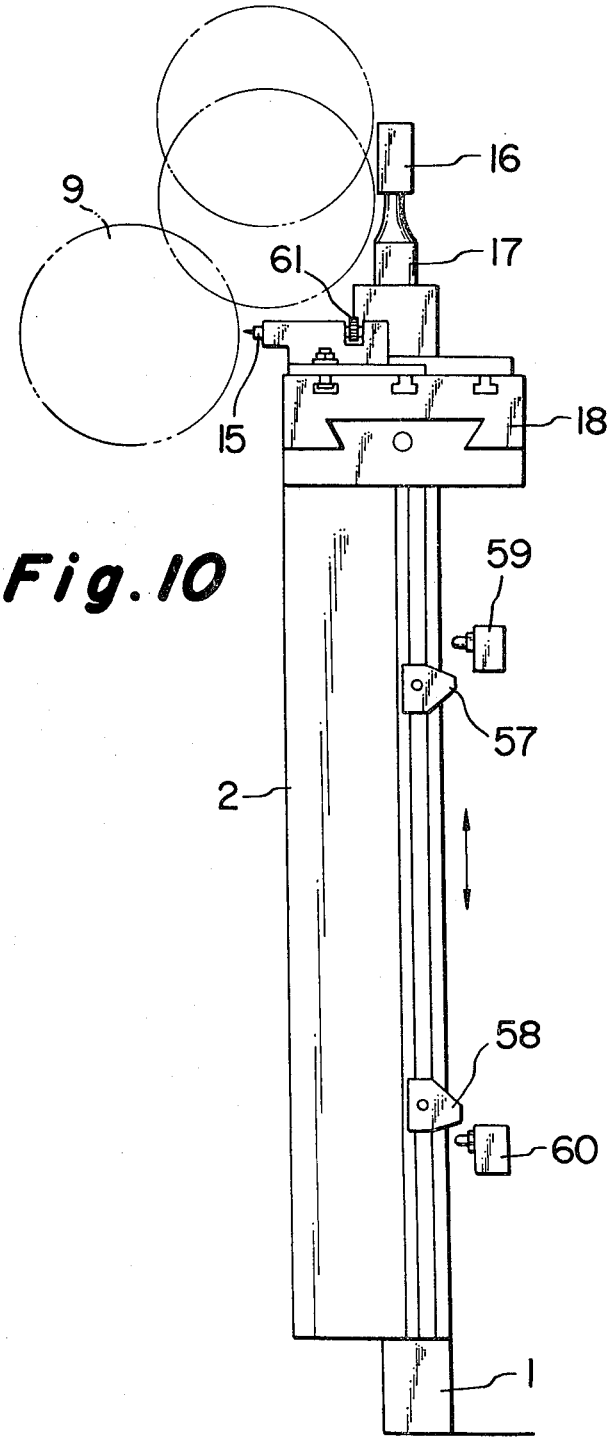

FIG. 10 is an enlarged view of the vertically sliding member 2. This vertically sliding member 2 is fixed with an upper striker 57 and a lower striker 58 whose positions are changeable. By on-off operating an upper limit switch 59 and a lower limit switch 60 provided on the machine 1, with a predetermined space therebetween, the upper limit position of the vertically sliding member during dressing and the lower limit position thereof at the start of the grinding operation are regulated. The dressing means 15 mounted on the movable table 18 at the top of the vertically sliding member 2 is moved back and forth by the operation of an adjusting nut 61. The tip of a dressing bar is positioned by the use of said microscope 33 so that it coincides with a reference line, with respect to the position of the grinder driven and controlled thereby.

While the workpiece is being ground, the dressing means 15 is lower than the lower limit position of the stroke of the grinding wheel 9 that grinds the workpiece 16 into a predetermined contour. When correcting arched surface of the periphery of the grinding wheel during the grinding operation, the grinding wheel must be detached from the workpiece by suitable control instructions, and the position of the dressing bar muust be moved to the same level as that of the horizontal revolving shaft 10 of the grinding wheel 9. For this purpose, the driving shaft 38 is first stopped where the switch lever 48 and the limit switch 49 have preliminarily been engaged, and then the piston rod 56, which is a locking pin of the adjusting shaft 36, is withdrawn to release locking. Following these actions, the pinion 54 is rotated to raise the adjusting shaft 36, and the vertically sliding member 2 is moved upward from an original position through the lever 35. When the upper striker 57 contacts the limit switch 59, the pinion 54 stops, and, therefore, the elevation of the vertically sliding member 2 also stops at a dressing position. By controlling the movement of the grinding wheel 9, the dressing means 15 correctingly grinds the arched surface of the periphery of the grinding wheel in accordance with the concentric reference circles marked in the microscope.

On completion of the correcting work, suitable instructions are given so that the vertically sliding member 2 is lowered by the descent of the adjusting shaft 36 resultant from the reversing of the pinion 54. When the striker 58 contacts the limit switch 60, the pinion 54 stops, and then the vertically sliding member 2 also stops at the original position. By the subsequent operation of the cylinder device 55, the piston rod 56 advances to lock the adjusting shaft 36. After making the limit switches 49, 59 and 60 inoperative, rotation of the driving shaft 38 is started again, the vertically sliding member 2 is moved up and down at the position, and the grinding operation is continued by the numerical control instructions to the grinding wheel. When the at the position dressing means 15 is within the grinding stroke of the workpiece, the angle of rotation of the eccentric 44 may be controlled to a desired angle by adjusting the position of the switch lever 48 at the end of the driving shaft 38, without employing the striker. By this means, the vertically sliding member 2 is moved, and the dressing means 15 is set to the position where the dressing of the grinding wheel is conducted.

The grinding wheel used for the contour grinding operation grinds the workpiece 16 into a desired contour, being driven by composite numerical control of the longitudinally moving table 3, laterally moving table 4 and vertical shaft 5, at a position where said grinding wheel is offset from the contour of the workpiece by the radius of the arched surface of the periphery of the grinding wheel. The condition of this grinding is inspected by the microscope 33 fitted to the vertical revolving shaft. When it becomes necessary to correct the arched surface of the periphery of the grinding wheel at work, using said microscope, the grinding operation is discontinued and the periphery of the grinder is reduced to a circle of smaller radius than the former one. Then, after correcting the amount of offsetting in accordance with the radius of the circle thus corrected, the grinding operation is continued from where it was stopped.

In the above-described embodiment of this invention, the grinding wheel is inched so that the center of its arched surface of the periphery is always on the extension of the axis of the vertical shaft, by turning the support arm and moving back and forth the horizontal revolving shaft of the grinding wheel with respect to the eccentric portion of the periphery. Furthermore, longitudinal, lateral and rotational movements of the vertical shaft is controlled by the numerically controlled pulse motor, thereby operating the grinder along the desired contour where the grinding locus of the grinder is offset from the workpiece by the radius of the arched surface of the periphery of the grinding wheel. As a consequence, this grinding wheel can grind the workpiece into the desired contour, without resorting to the conventional contour grinding methods.

In positioning the workpiece on the holder, the reference line marked in the microscope is used. Correction of the relative position of the workpiece with respect to the grinding wheel, depending on its size and shape, is effected by adjusting the sliding position of the vertically sliding member to a desired position, with adjustment being carried out by changing the length of the stroke of the reciprocating motion of the vertically sliding member by adjusting the eccentricity to a desired value, and also by displacing the center of said stroke. These adjustments are all done either manually or by numerical control. Therefore, the workpiece is always ground at a right position with respect to the grinding wheel.

In addition, the arched surface of the periphery of the grinding wheel is inspected by the microscope provided in the vertical shaft. In case any deformation occurs, the grinding operation is immediately discontinued, and the grinding wheel is separated from the workpiece. Then, the dressing means is elevated up to the dressing position by adjusting the positions of the limit switches. The arched surface of the periphery of the grinding wheel is corrected in accordance with the reference circle marked in the microscope, moving and rotating the grinding wheel by the dressing bar. The workpiece is held at a high position on the holder. The grinding wheel is fitted to the end of the support arm curvedly fitted to the vertical shaft so that it comes alongside the workpiece. The pulleys transmitting the force for rotating the grinding wheel are rotatably fitted on the revolving shafts and the support arm, through which the belts are passed from above onto the shaft of the grinding wheel. Therefore, the grinding wheel is capable of performing the grinding operation, turning through 360° round the workpiece. This provides a function to achieve the grinding operation very efficiently.

What we claim is:

1. A contour grinder for grinding the contour of a workpiece into a desired shape with a grinding wheel having an arched surface on the periphery thereof, said grinder comprising:

a rotatable substantially horizontally extending shaft, a grinding wheel having an arched surface on the periphery thereof, said grinding wheel being fixed to said shaft, a substantially vertically extending shaft, means for rotating said substantially vertically extending shaft on its substantially vertically extending axis, said means comprising a motor driven and controlled by numerical control means, means for moving said substantially vertically extending shaft longitudinally and laterally, said moving means comprising motors driven and controlled by numerical control means, means connecting said substantially horizontally extending shaft to said substantially vertically extending shaft at a substantially right angle thereto for aligning the center of the arched surface on the periphery of the grinding wheel with the center of the substantially vertically extending shaft, a substantially vertically slidable member on which a workpiece to be ground by the grinding wheel is mounted, and means for substantially vertically reciporcatingly moving said vertically slidable member.

2. A contour grinder according to claim 1, further comprising:

dressing means for correcting the arched surface of the grinding wheel, said dressing means being mounted on said vertically slidable member.

3. A contour grinder according to claim 2, further comprising:

control means for selectively controlling the position at which reciprocating movement of said vertically slidable member is stopped.

4. A contour grinder according to claim 3, wherein:

said means for substantially vertically reciprocatingly moving said vertically slidable member comprises a driving shaft and an eccentric fixed to said driving shaft, said control means comprises a switch lever and a limit switch adapted to engage with said switch lever, and said switch lever is connected to said driving shaft.

5. A contour grinder according to claim 3, further comprising:

driving means for adjusting the vertical position of the vertically slidable member.

6. A contour grinder according to claim 5, further comprising:

control means for vertically adjustably driving said dressing means to, and stopping it at, a predetermined dressing position and back to a predetermined original position.

7. A contour grinder according to claim 6, further comprising:

at least one striker mounted on said vertically slidable member, and at least one limit switch adapted to engage said at least one striker to stop said dressing means at the dressing position and at the original position.

8. A contour grinder according to claim 1, wherein:

said substantially vertically extending shaft has an eccentric periphery at a portion thereof, and said connecting means comprises a support arm rotatably adjustably connected to the eccentric periphery of the substantially vertically extending shaft.

9. A contour grinder according to claim 8, further comprising:

a sheave fixed to said rotatable substantially horizontally extending shaft, a drive pulley rotatably mounted on said substantially vertically extending shaft, a take-up pulley mounted on said support arm, a grinding wheel drive belt trained about said sheave, said drive pulley and said take-up pulley, and means for driving said drive belt whereby said grinding wheel is rotatably about the axis of the substantially horizontally extending shaft and is also rotatable about the substantially extending shaft.

10. A contour grinder according to claim 1, wherein:

said substantially vertically extending shaft is hollow, and a microscope, marked with reference lines for inspecting the shape of the periphery of the grinding wheel and the position of a workpiece to be ground by the grinding wheel, is mounted in said hollow shaft.

11. A contour grinder according to claim 1, further comprising:

means for changing the stroke of the reciprocating motion of the vertically slidable member, and driving means for adjusting the vertical position of the vertically slidable member.

* * * * *